US006747624B1

(12) United States Patent
Udo et al.

(10) Patent No.: US 6,747,624 B1
(45) Date of Patent: Jun. 8, 2004

(54) DRIVING CIRCUIT FOR SUPPLYING TONE VOLTAGES TO LIQUID CRYSTAL DISPLAY PANEL

(75) Inventors: Shinya Udo, Kanagawa (JP); Osamu Kudo, Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/501,009

(22) Filed: Feb. 9, 2000

(30) Foreign Application Priority Data

Aug. 19, 1999 (JP) ..... 11-233128

(51) Int. Cl.[7] ..... G09G 3/36
(52) U.S. Cl. ..... 345/89; 345/95; 345/210
(58) Field of Search ..... 345/87–101, 204–214

(56) References Cited

U.S. PATENT DOCUMENTS 5,343,221 A * 8/1994 Arakawa et al. ..... 345/211
6,140,989 A * 10/2000 Kato ..... 345/89
6,188,395 B1 * 2/2001 Yatabe ..... 345/211
6,232,941 B1 * 5/2001 Ode et al. ..... 345/95
6,501,467 B2 * 12/2002 Miyazaki ..... 345/210

FOREIGN PATENT DOCUMENTS

JP 5313605 11/1993
JP 9218671 8/1997
JP 10304282 11/1998

* cited by examiner

*Primary Examiner*—Amr Awad
(74) *Attorney, Agent, or Firm*—Greer, Burns & Crain, Ltd.

(57) ABSTRACT

In the LCD panel driving circuit, the voltage of first and second buffer amplifiers is supplied to first output pad, the voltage of second and third buffer amplifiers is supplied to second output pad, and voltage of third and fourth buffer amplifiers is supplied to third output pad. Thus, data-line selection switches and output-polarity selection switches are switched in such a way that the voltage supplied to any adjacent output pads is always supplied from adjacent buffer amplifiers.

7 Claims, 5 Drawing Sheets

DRIVING CIRCUIT FOR SUPPLYING TONE VOLTAGES TO LIQUID CRYSTAL DISPLAY PANEL

FIELD OF THE INVENTION

The present invention relates to an LCD (liquid crystal display) panel driving circuit. In recent years, the LCD has rapidly been widespread as a display unit for television and office equipment for ordinary home use. The reasons behind this are that the LCD is thin and lightweight as compared to a CRT and the display quality is not very inferior to that of the CRT can be obtained.

BACKGROUND OF THE INVENTION

FIG. 1 is a schematic view showing the key portions of a conventional LCD panel driving circuit. The driving circuit comprises n units of selectors 11(1), 11(2), . . . , **11(*n*); n units of operational amplifiers 12(1), 12(2), . . . , 12(*n*) each operating as a buffer amplifier; and n units of output-polarity selection switches 13(1), 13(2), . . . , 13(*n*)**. Wherein n is a multiple of 2.

Of the selectors 11(1), 11(2), . . . , **11(*n*), for instance, odd-numbered selectors are dedicated to positive-polarity output, and even-numbered selectors are dedicated to negative-polarity output. Input into each of the selectors 11(1), 11(3), . . . , 11(n−1) dedicated to the positive-polarity output are, for instance, 6-bit data for positive-polarity output and a positive tone voltage. Input, on the other hand, into each of the selectors 11(2), 11(4), . . . , 11(*n*)** dedicated to the negative-polarity output are, for instance, 6-bit data for negative-polarity output and a negative tone voltage.

Of the operational amplifiers 12(1), 12(2), . . . , **12(*n*), half of them are operational amplifiers dedicated to positive-polarity output, and the remaining half are dedicated to negative-polarity output. Output voltage from the selectors 11(1), 11(3), . . . , 11(n−1) for positive-polarity output respectively loaded into each of the non-inverted terminal of the operational amplifiers 12(1), 12(3), . . . , 12**(n−1) for positive-polarity output.

Output voltage from the selectors **11*b*, 11*d*, . . . , and 11*n* for positive-polarity output is respectively loaded into each non-inverted input terminal of the operational amplifiers 12*b*, 12*d*, and 12*m*** for negative-polarity output.

The output-polarity selection switches 13(1), 13(2), . . . , **13(*n*) are connected to output pads 14(1), 14(2), . . . , 14(*n*) respectively. The output pads 14(1), 14(2), . . . , 14(*n*)** are electrically connected to a LCD panel not shown herein.

Effects of an LCD panel driving circuit are explained below together with each switching operation of the output-polarity selection switches 13(1), 13(2), . . . , **13(*n*). However, it is assumed that k is an integer of 1 or more than 1 for convenience in description. When 2*k*−1-th data D2*k*−1 has a positive polarity, the data D2*k*−1 is inputted into a 2*k***−1-th selector.

The **2*k*−1-th output-polarity selection switches are electrically connected towards positive polarity (the broken line shown in FIG. 1). Therefore, the positive-polarity driving voltage output from the 2*k*−1-th selectors is output to 2*k*−1-th output pads via the 2*k*−1-th operational amplifiers and the 2*k***−1-th output-polarity selection switches.

Here, **2*k*-th data D2*k* acquires a negative polarity and is inputted into 2*k*-th selectors. Therefore, 2*k*-th output-polarity selection switches are electrically connected towards negative polarity (the broken lines shown in FIG. 1). Therefore, the negative-polarity driving voltage output from the 2*k*-th selectors is output to 2*k*-th output pads via the 2*k*-th operational amplifiers and the 2*k***-th output-polarity selection switches.

Namely, the driving voltages of **2*k*−1-th data lines acqure a positive-polarity driving voltage based on positive-polarity data D2*k*−1, whereas the driving voltages of 2*k*-th data lines acquire a negative-polarity driving voltage based on negative-polarity data D2*k***.

The data D**2*k*−1 and data D2*k* invert polarity at a prespecified cycle in the previous stages of the 2*k*−1-th and 2*k*-th selectors. The data D2*k*-1 with negative polarity is input into the 2*k*-th selectors. The data D2*k* with positive polarity is input to the 2*k*−1-th selectors. The 2*k*−1-th output-polarity selection switches are electrically connected towards negative polarity (the solid line in FIG. 1). The 2*k*-th output-polarity selection switches are electrically connected towards positive polarity (the solid line in FIG. 1**).

Therefore, the negative-polarity driving voltage output from the **2*k*-th selectors is output to 2*k*−1-th output pads via the 2*k*-th operational amplifiers and the 2*k*−1-th output-polarity selection switches. Each positive-polarity driving voltage outputted from the 2*k*−1-th selectors is output to 2*k*-th output pads via the 2*k*−1-th operational amplifiers and the 2*k***-th output-polarity selection switches.

Namely, the driving voltages of the **2*k*−1-th data lines acquire negative-polarity driving voltage based on negative-polarity data D2*k*−1, whereas the driving voltages of the 2*k*-th data lines acquire positive-polarity driving voltage based on positive-polarity data D2*k*. Therefore, a positive-polarity driving voltage based on the positive-polarity data D2*k*−1 and a negative-polarity driving voltage based on the negative-polarity data D2*k*−1 are alternately loaded to each driving voltage of the 2*k***−1-th data lines at a prespecified cycle.

Further, a negative-polarity driving voltage based on the negative-polarity data D**2*k* and a positive-polarity driving voltage based on the positive-polarity data D2*k* are alternately loaded to each driving voltage of the 2*k***-th data lines at a prespecified cycle.

The positive-polarity driving voltage based on the positive-polarity data D**2*k*−1 and the negative-polarity driving voltage based on the negative-polarity data D2*k*−1 are opposite in polarity, but has the same level. The same is true with respect to the negative-polarity driving voltage based on the negative-polarity data D2*k* and the positive-polarity driving voltage based on the positive-polarity data D2*k***.

The reason why AC driving is performed such that a positive-polarity driving voltage and a negative-polarity driving voltage are alternately loaded to an identical pixel at a prespecified cycle as described above is because inconvenience of degradation in a liquid crystal under the situation where a voltage with the same polarity is kept on being loaded to an identical pixel should be avoided. However, screen flicker occurs due to AC driving. To suppress the flicker, in the LCD, driving voltages opposite in polarity are loaded to adjacent data lines, and voltages opposite in polarity are loaded to adjacent pixels.

In the above-described conventional type of LCD panel driving circuit, each driving voltage of the **2*k*−1-th data lines is prepared with each output voltage from the 2*k*−1-th operational amplifiers and each output voltage from the 2*k*-th operational amplifiers. Further, each driving voltage of the 2*k*-th data lines is also prepared with each output voltage from the 2*k*−1-th operational amplifiers and each output voltage from the 2*k***-th operational amplifiers.

Therefore, even when there are offset voltages in the $2k-1$-th and $2k$-th operational amplifiers, an offset difference does not occur between each driving voltage of the $2k-1$-th data lines and each driving voltage of the $2k$-th data lines. Similarly, even when there are offset voltages in the $2k+1$-th and $2k+2$-th operational amplifiers, an offset difference does not occur between each driving voltage of the $2k+1$-th data lines and each driving voltage of the $2k+2$-th data lines.

However, when an offset voltage in the $2k-1$-th operational amplifier and that in the $2k+1$-th operational amplifier are opposite in polarity or an offset voltage in the $2k$-th operational amplifier and that in the $2k+2$-th operational amplifier are opposite in polarity, even if identical-tone display is performed, a large voltage difference occurs between each driving voltage in the $2k$-th data lines and each driving voltage in the $2k+1$-th data lines. Therefore, there is a problem such that unevenness in brightness and longitudinal streaks may appear on the screen on display of identical tone.

The occurrence of offset voltages in operational amplifiers is caused by variations in the manufacturing process of transistors. Therefore, in the conventional technology, variations in the manufacturing process are decreased by increasing the area of a transistor forming a current mirror circuit so that an offset voltage in an operational amplifier can be made smaller. However, this technology has a weak point that the size of the LCD panel driving circuit increases.

SUMMARY OF THE INVENTION

It is an object of the present invention to provide an LCD panel driving circuit for making the panel perform high-quality display without an unevenness in the brightness and longitudinal streaks on a screen without the necessity of increasing a scale of the circuit.

In the present invention, the tone voltages supplied to any two adjacent output terminals among a plurality of output terminals which are arranged on one line are always output from two adjacent buffer amplifiers among a plurality of buffer amplifiers which are arranged on one line.

Further, the present invention comprises j units of first-polarity selectors, j units of second-polarity selectors, j units of data-line selection switches, j units of first-polarity buffer amplifiers, j+1 units of second-polarity buffer amplifiers, and $2j$ units of output-polarity selection switches. Output voltage of each of the $2j$ units of selectors is supplied to each of the $2j$ data lines via the data-line selection switches, the buffer amplifiers, and the output-polarity selection switches.

Further, the first-polarity selectors are connected to the corresponding first-polarity buffer amplifiers. Each of the first-polarity buffer amplifiers is connected to either one of a first data line and a second data line which are adjacent to each other via the corresponding output-polarity selection switch. Each of the second-polarity selectors is connected to either one of the corresponding pair of second-polarity buffer amplifiers via the corresponding data-line selection switch.

Of the pair of second-polarity buffer amplifiers, one of the buffer amplifiers is connected to either one of the first data line and a third data line adjacent thereto via the corresponding output-polarity selection switch. The other one of the buffer amplifiers is connected to either one of the second data line and a fourth data line adjacent thereto via the corresponding output-polarity selection switch. The data-line selection switches and the output-polarity selection switches are concurrently switched at a prespecified timing.

With the above-described configuration, output voltage of the first-polarity buffer amplifier and the output voltage of one of the pair of second-polarity buffer amplifiers are supplied to the first data line. Further, output voltage of the first-polarity buffer amplifier and the output voltage of the other one of the pair of second-polarity buffer amplifiers are supplied to the second data line.

Further, output voltage of the other one of the pair of second-polarity buffer amplifiers and the output voltage of a first-polarity buffer amplifier different from the first-polarity buffer amplifier connected to the first or second data line are supplied to the third data line. Similarly, output voltage of one of the pair of second-polarity buffer amplifiers and the output voltage of a first-polarity buffer amplifier different from the first-polarity buffer amplifier connected to the first, second, or third data line are supplied to the fourth data line.

Namely, a common buffer amplifier is connected to any adjacent data lines. Therefore, it is possible to prevent occurrence of a large difference in driving voltages for performing identical tone display between any adjacent data lines, thus appearance of unevenness in brightness as well as of longitudinal streaks on a screen can be prevented on display of identical tone.

In addition, with the above-described configuration, when an operational amplifier is used as a buffer amplifier, the need to decrease the offset voltage in the operational amplifier by increasing the area of a transistor forming a current mirror circuit is eliminated, thus the scale of the LCD panel driving circuit can be reduced. Resultantly, by using this LCD panel in a display, the display can be downsized.

Other objects and features of this invention will become apparent from the following description with reference to the accompanying drawings.

DESCRIPTION OF THE PREFERRED EMBODIMENTS

Figure 1:
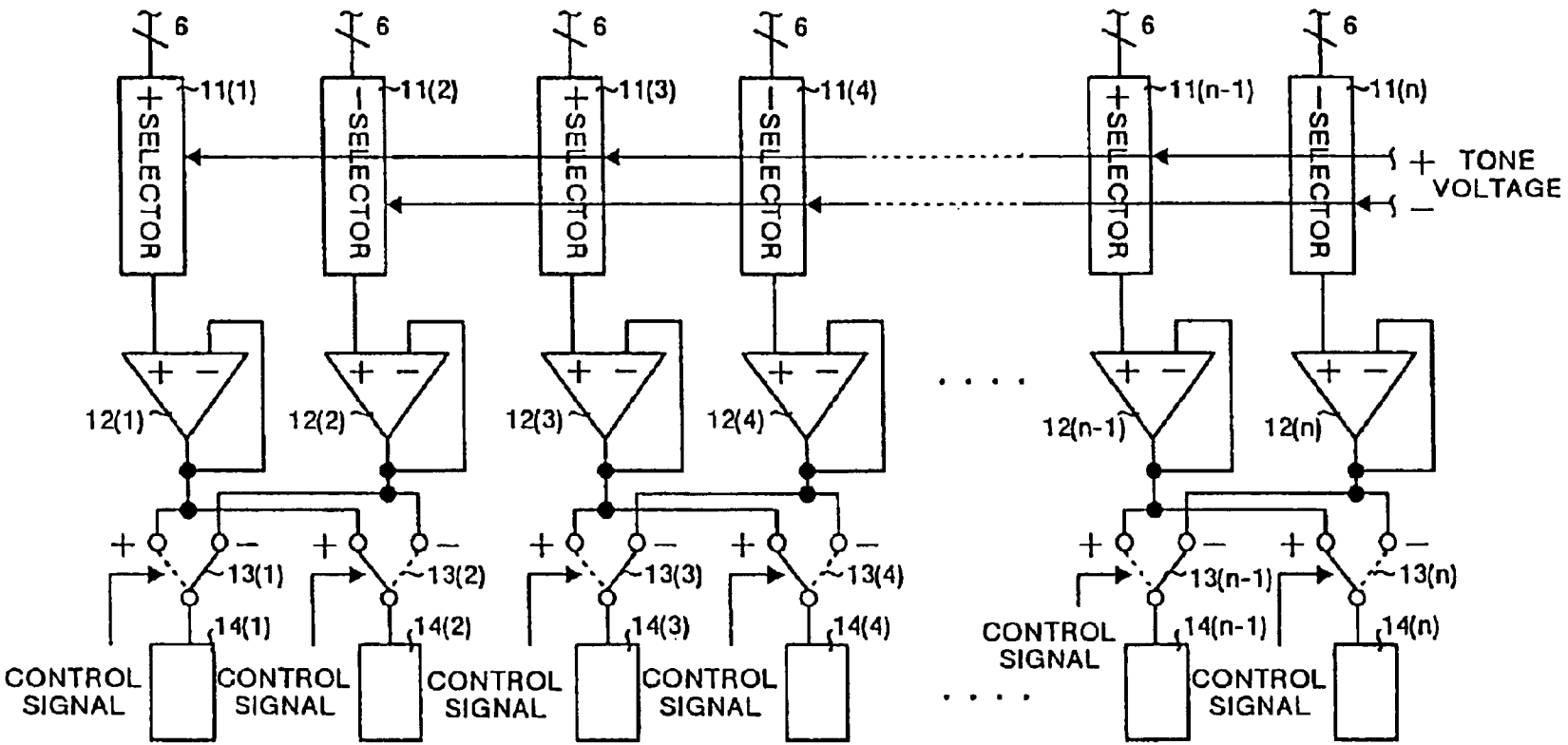
FIG.1 PRIOR ART
FIG. 1 is a schematic view showing the key portions of the conventional type of LCD panel driving circuit.
Figure 2:
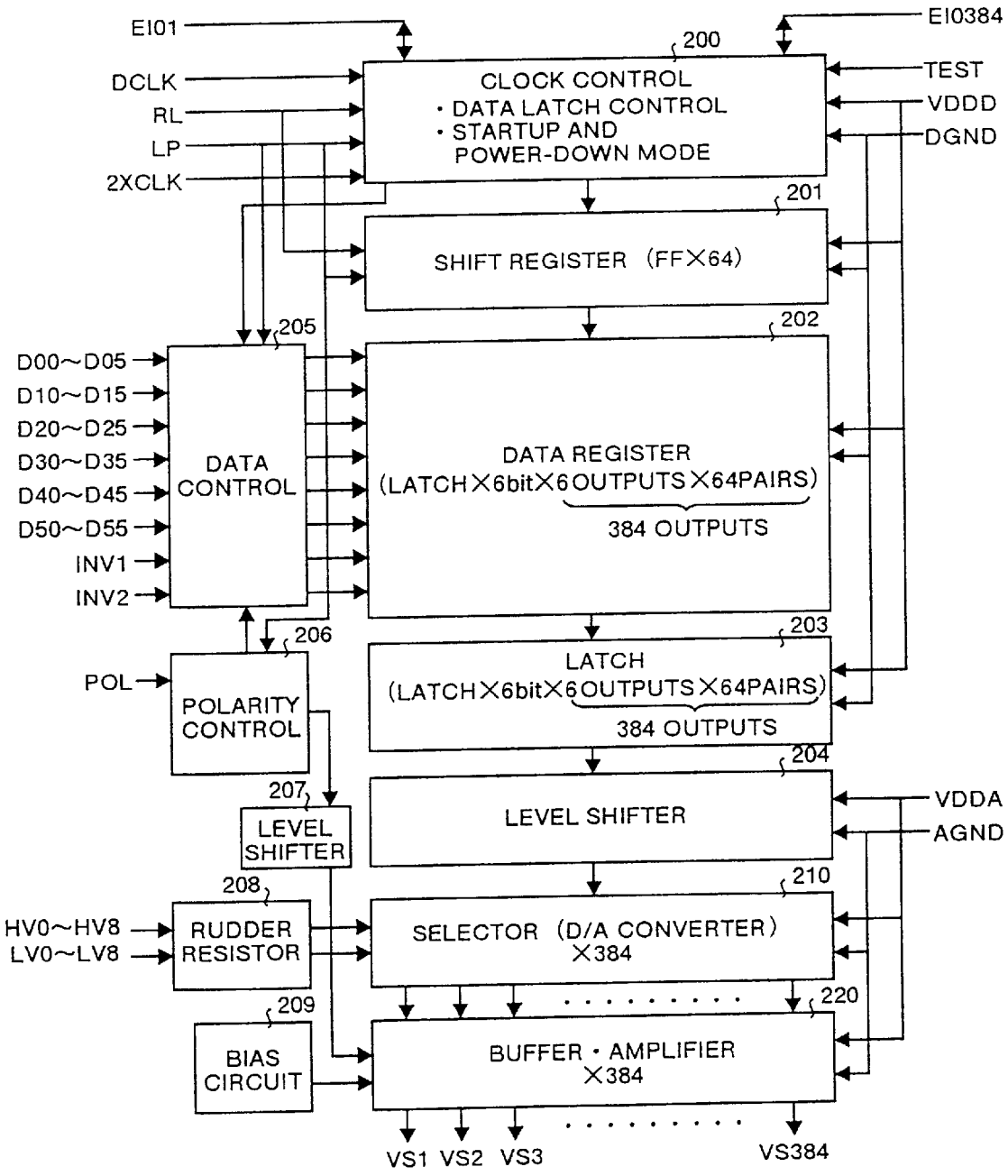
FIG. 2 is a block diagram showing entire configuration of an LCD panel driving circuit with the present invention applied therein.

Preferred embodiment of the present invention is described in detail below with reference to FIG. 2 to FIG. 5. FIG. 2 is a block diagram showing entire configuration of an LCD panel driving circuit with the present invention applied therein.

As shown in FIG. 2, the LCD panel driving circuit comprises a clock control 200, a shift register 201, a data register 202, a latch 203, level shifters 204 and 207, a selector 210, a buffer amplifier 220, a data control 205, a polarity control 206, a rudder resistor 208, and a bias circuit 209.

The clock control 200 receives enable signals EI01 to EI0384 from an external device and prepares for receiving data. When finishing reception of data, the clock control 200 outputs an enable signal to a next IC, and enters into a power-down mode. A clock DCLK, a right-left shift signal RL, and a data transfer signal LP are input into the clock control 200 from an external device, and a power supply voltage VDDD and an earth voltage DGND are supplied from a digital power unit not shown herein. The power supply voltage VDDD and the earth voltage DGND are supplied also to the shift register 201, data register 202, and latch 203.

Input into the shift register 201 are a right-left shift signal RL and a data transfer signal LP. Input into the data control 205 are data transfer signal LP, data D00 to D05, D10 to D15, D20 to D25, D30 to D35, D40 to D45, and D50 to D55, and data inversion signals INV1 and INV2. Input into the data register 202 is the data output from the data control 205. The data register 202 successively fetches the data of 6 outputs each comprising 6 bits.

Input into the polarity control 206 is a polarity inversion signal POL from an external device. The polarity control 206 generates a signal for switching polarities of each output according to an inputted polarity inversion signal POL. The latch 203 latches tone data during its outputting. Fed into the level shifter 204, selector 210, and buffer amplifier 220 are a power supply voltage VDDD and an earth voltage AGND from an analog power unit not shown herein.

Input into the rudder resistor 208 are tone voltages (external tone voltages) HV0 to HV8 and LV0 to LV8 from an external device. The selector 210 selects from 64-tone voltages generated by dividing the external tone voltage thereinto based on resistance in the rudder resistor 208. The buffer amplifier 220 buffers the voltage selected in the selector 210 and outputs the voltage.

Figure 3:
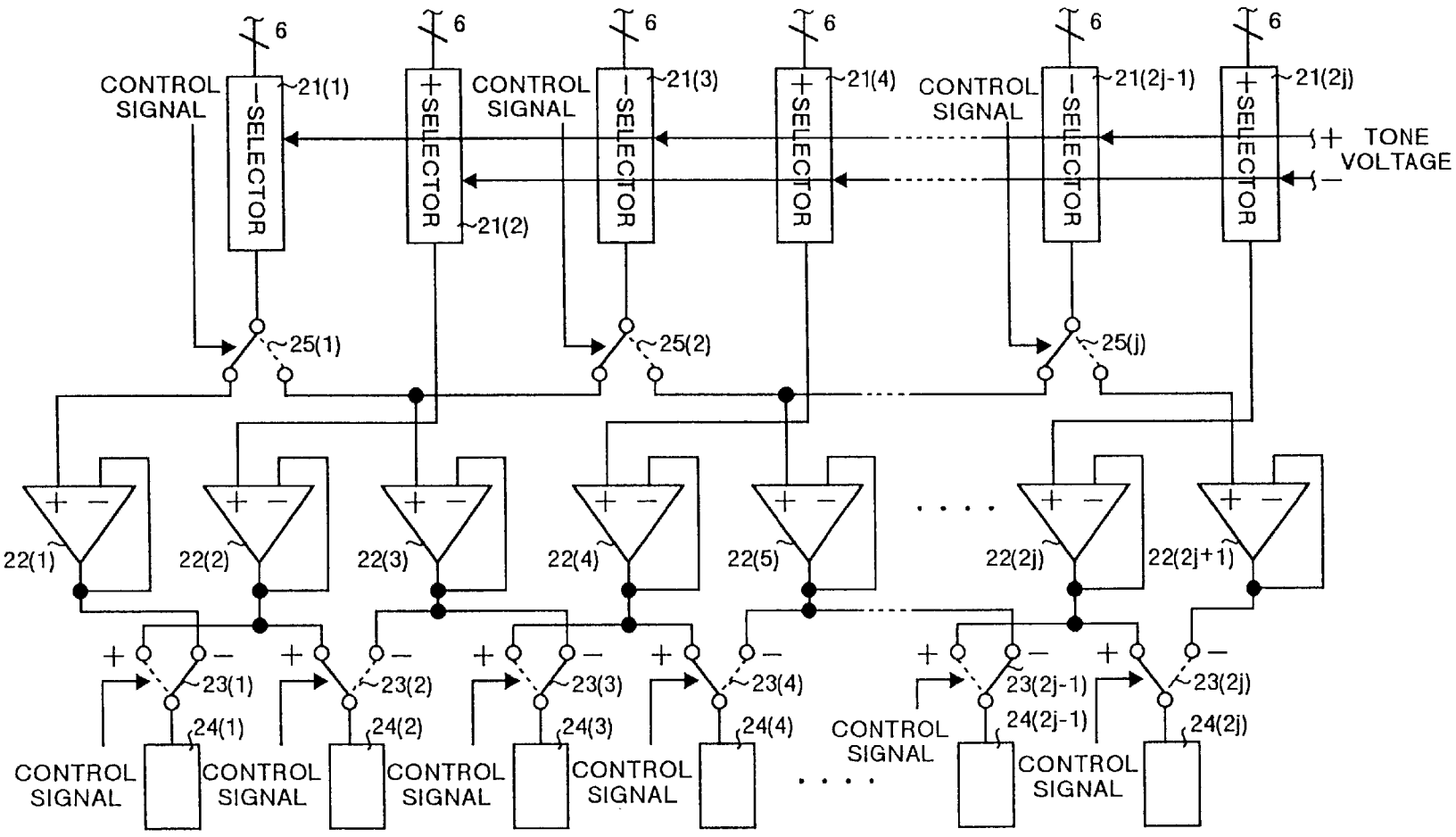
FIG. 3 is a schematic view showing details of a circuit block consisting of a selector and a buffer amplifier of the LCD panel driving circuit according to the present invention.

FIG. 3 is a schematic view showing details of a circuit block consisting of the selector 210 and buffer amplifier 220 of the LCD panel driving circuit according to this embodiment.

As shown in FIG. 3, the circuit block consisting of the selector 210 and buffer amplifier 220 comprises 2*j* units of selectors 21(1), 21(2), . . . , 21(2*j*); j units of data-line selection switches 25(1), 25(2), . . . , 25(*j*); 2*j*+1 units of buffer amplifiers 22(1), 22(2), . . . , 22(2*j*+1); and 2*j* units of output-polarity selection switches 23(1), 23(2), . . . , 23(2*j*) Wherein j is a natural number such as j=192.

Each of the selectors 21(1), 21(2), . . . , 21(2*j*) is formed by, for instance, an D/A converter. Of the selectors 21(1), 21(2), . . . , 21(2*j*), for instance, odd-numbered selectors are dedicated to negative-polarity output, and even-numbered selectors are dedicated to positive-polarity output. Input into each of the selectors 2l(1), 21(3), . . . , 21(2*j*−1) dedicated to the negative-polarity output are, for instance, 6-bit data for negative-polarity output and a negative tone voltage. Input, on the other hand, into each of the selectors 21(2), 21(4), . . . , 21(2*j*) dedicated to the positive-polarity output are, for instance, 6-bit data for positive-polarity output and a positive tone voltage.

Each of the buffer amplifiers 22(1), 22(2), . . . , 22(2*j*+1) is formed by, for instance, an operational amplifier. Of the buffer amplifiers 22(1), 22(2), . . . , 22(2*j*+1), for instance, j+1 units of odd-numbered buffer amplifiers are dedicated to negative-polarity output, and j units of even-numbered selectors are dedicated to positive-polarity output. Loaded into each non-inverted input terminal of the buffer amplifiers 22(2), 22(4), . . . , 22(2*j*) for the positive-polarity output is an output voltage from the selectors 21(2), 21(4), . . . , 21(2*j*) for the positive-polarity output respectively.

The data-line selection switches 25(1), 25(2), . . . , 25(*j*) are connected to output terminals of the selectors 21(1), 21(3), . . . , 21(2*j*−1) for the negative-polarity output respectively. Herein, assuming k is a natural number, the data-line selection switch alternatively switches a target for output of a 2*k*−1-th selector (for negative-polarity output), at a predetermined timing, to a non-inverted input terminal of the 2*k*−1-th buffer amplifier (for negative-polarity output) or to a non-inverted input terminal of the 2*k*+1-th buffer amplifier (for negative-polarity output). The switching operation is performed by a control signal inputted from the external device.

The output-polarity selection switches 23(1), 23(2), . . . , 23(2*j*) are connected to output pads 24(1), 24(2), . . . , 24(2*j*) respectively. The output pads 24(1), 24(2), . . . , 24(2*j*) are electrically connected to an LCD panel not shown herein.

Fed into a 2*k*−1-th output pad is an output voltage from the 2*k*−1-th buffer amplifier (for negative-polarity output) or an output voltage from the 2*k*-th buffer amplifier (for positive-polarity output) at a predetermined timing by being alternatively switched by the output-polarity selection switch. Fed into a 2*k*-th output pad is an output voltage from the 2*k*-th buffer amplifier (for positive-polarity output) or an output voltage from the 2*k*+1-th buffer amplifier (for negative-polarity output) at a predetermined timing by being alternatively switched by the output-polarity selection switch. The 2*k*−1-th output pad and 2*k*-th output pad are connected to a 2*k*−1-th data line and a 2*k*-th data line adjacent thereto respectively.

The switching operation of the output-polarity selection switches 23(1), 23(2), . . . , 23(2*j*) is performed by a control signal inputted from the external device. The switching timing of the output-polarity selection switches 23(1), 23(2), . . . , 23(2*j*) synchronizes to each switching timing of the data-line selection switches 25(1), 25(2), . . . , 25(*j*). Each of those switches is formed by, for instance, a MOSFET.

When the data-line selection switches 25(1), 25(2), . . . , 25(*j*) select the 2*k*−1-th buffer amplifiers as each target for output of the 2*k*−1-th selectors, the output-polarity selection switches 23(1), 23(2), . . . , 23(2*j*) switch so as to feed each output voltage from the 2*k*−1-th and 2*k*-th buffer amplifiers to the 2*k*−1-th and 2*k*-th output pads respectively.

When the data-line selection switches 25(1), 25(2), . . . , 25(*j*) select the 2*k*+1-th buffer amplifiers as each target for output of the 2*k*−1-th selectors, the output-polarity selection switches 23(1), 23(2), . . . , 23(2*j*) switch so as to feed each output voltage from the 2*k*-th and 2*k*+1-th buffer amplifiers to the 2*k*−1-th and 2*k*-th output pads respectively.

Figure 4:
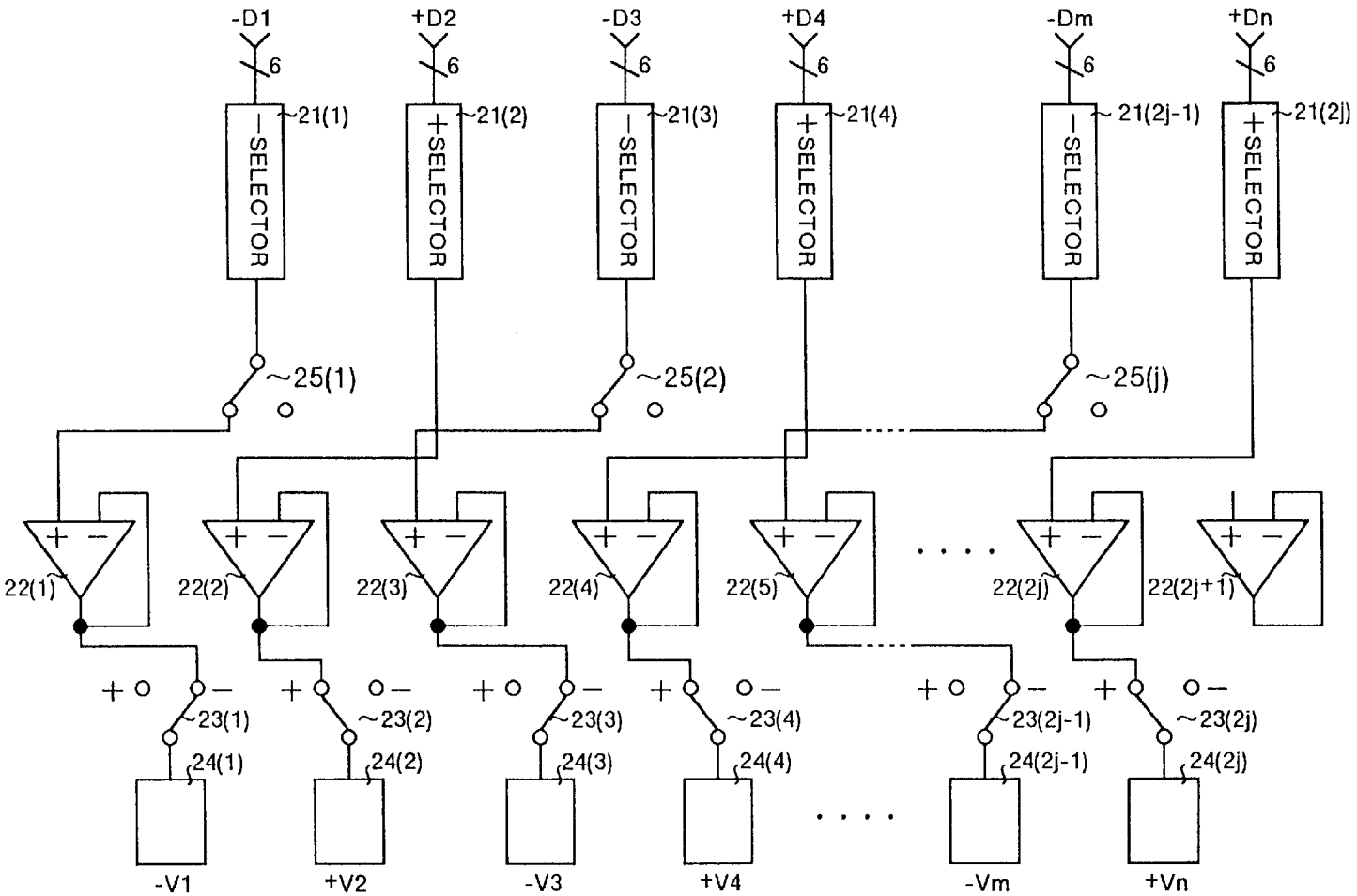
FIG. 4 is a simulated view showing effects of the LCD panel driving circuit shown in FIG. 3.

Effects of this embodiment are described below. FIG. 4 is a view showing a status where the 2*k*−1-th buffer amplifiers are selected by the data-line selection switches 25(1), 25(2), . . . , 25(*j*) as each target for output of the 2*k*−1-th selectors.

More specifically, first data D1, third data D3, and 2*j*-th data D2*j*−1 are negative-polarity data, and are input into the first selector 21(1), third selector 21(3), and (2*j*+)-th selector 21(2*j*−1) respectively.

On the other hand, second data D2, fourth data D4, and 2*j*-th data D2*j* are positive-polarity data, and are inputted into the second selector 21(2), fourth selector 21(4), and 2*j*-th selector 21(2*j*) respectively.

The first selector 21(1), second selector 21(2), third selector 21(3), fourth selector 21(4), 2*j*−1-th selector 21(2*j*−1), and 2*j*-th selector 212*j* send each tone voltage selected according to the input data to the first buffer amplifier 22(1), second buffer amplifier 22(2), third buffer amplifier 22(3), fourth buffer amplifier 22(4), 2*j*−1-th buffer amplifier 22(2*j*−1), and 2*j*-th buffer amplifier 22(2*j*) respectively.

The first buffer amplifier 22(1), third buffer amplifier 22(3), and 2*j*−1-th buffer amplifier 222*j*−1 feed negative-polarity driving voltages V1, V3, and V2$j$−1 to the first output pad 24(1), third output pad 24(3), 2$j$−1-th output pad 242$j$−1 respectively. In addition, the second buffer amplifier 22(2), fourth buffer amplifier 22(4), and 2$j$-th buffer amplifier 22(2$j$) feed positive-polarity driving voltages V2, V4, and V2$j$ to the second output pad 24(2), fourth output pad 24(4), 2$j$-th output pad 24(2$j$) respectively.

Figure 5:
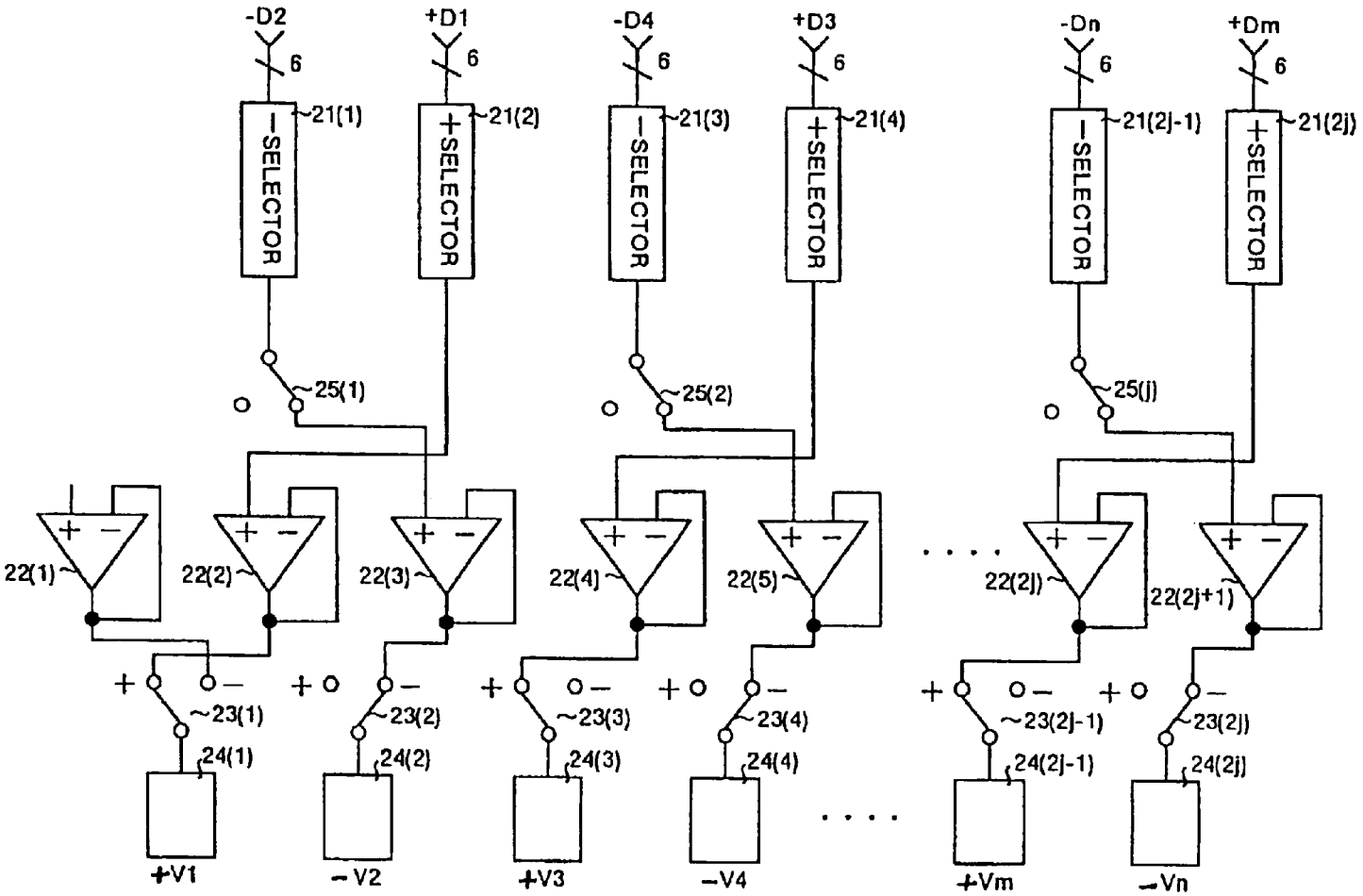
FIG. 5 is another simulated view showing effects of the LCD panel driving circuit shown in FIG. 3.

FIG. 5 is a view showing a status where the 2$k$+1-th buffer amplifiers are selected by the data-line selection switches 25(1), 25(2), . . . , 25($j$) as each target for output of the 2$k$−1-th selectors. Each of the data D1, D2, . . . , D2$j$ is inverted one stage before the selectors at a prespecified period.

The first data D1, third data D3, and 2$j$−1-th data D2$j$−1 are positive-polarity data, and are input into the second selector 21(2), fourth selector 21(4), and 2$j$-th selector 21(2$j$) respectively. On the other hand, the second data D2, fourth data D4, and 2$j$-th data Dn are negative-polarity data, and are input into the first selector 21(1), third selector 21(3), and 2$j$−1-th selector 21(2$j$−1) respectively.

The first selector 21(1), second selector 21(2), third selector 21(3), fourth selector 21(4), 2$j$−1-th selector 21(2$j$−1), and 2$j$-th selector 21(2$j$) send each tone voltage selected according to the input data to the third buffer amplifier 22(3), second buffer amplifier 22(2), fifth buffer amplifier 22(5), fourth buffer amplifier 22(4), 2$j$+1-th buffer amplifier 22(2$j$+1), and n-th buffer amplifier 22$n$ respectively.

The second buffer amplifier 22(2), fourth buffer amplifier 22(4), and 2$j$-th buffer amplifier 22(2$j$) feed positive-polarity driving voltages V1, V3, and V2$j$−1 to the first output pad 24(1), third output pad 24(3), and 2$j$−1-th output pad 24(2$j$−1) respectively.

The third buffer amplifier 22(3), fifth buffer amplifier 22(5), and 2$j$+1-th buffer amplifier 22(2$j$+1) feed negative-polarity driving voltages V2, V4, and V2$j$ to the second output pad 24(2), fourth output pad 24(4), and 2$j$-th output pad 24(2$j$) respectively.

With the embodiment described above, an output voltage from the first buffer amplifier 22(1) and an output voltage from the second buffer amplifier 22(2) are fed to the first output pad 24(1). An output voltage from the second buffer amplifier 22(2) and an output voltage from the third buffer amplifier 22(3) are fed to the second output pad 24(2).

Fed to the third output pad 24(3) are an output voltage from the third buffer amplifier 22(3) and an output voltage from the fourth buffer amplifier 22(4). As described above, a common buffer amplifier is surely connected to any adjacent output pads.

Further, each output voltage (tone voltage) fed to any two adjacent units of output pad is always fed from any adjacent two units of buffer amplifier among a plurality of buffer amplifiers.

Therefore, it is possible to prevent occurrence of a large difference in driving voltages for displaying identical tone between any adjacent data lines, thus appearance of unevenness in brightness as well as of longitudinal streaks on a screen can be prevented on display of identical tone.

In addition, with the above-described embodiment, there is no need to decrease the offset voltage of the operational amplifier forming a buffer amplifier by increasing the area of the transistor forming a current mirror circuit. Therefore, circuit scale of the LCD panel driving circuit can be reduced. Resultantly, by using this LCD panel in a display, the display can be downsized.

As described above, it is to be understood that modification and variation of the present invention are possible in light of the above teachings. For example, the buffer amplifier may be replaced with any element other than the operational amplifier. In addition, an arrangement of polarities of selectors and buffer amplifiers may be reversed.

With the present invention, driving voltages on display of identical tone are uniformed between adjacent pixels, thus appearance of unevenness in brightness as well as of longitudinal streaks on a screen can be prevented. In addition, when an operational amplifier is used as a buffer amplifier, there is no need to decrease the offset voltage of the operational amplifier by increasing the area of the transistor forming a current mirror circuit. Therefore, circuit scale of the LCD panel driving circuit can be reduced.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An LCD panel driving circuit comprising:

a plurality of buffer amplifiers which are arranged so as to form a line and supply tone voltages to a plurality of output terminals which are also arranged so as to form a line, wherein tone voltages supplied to any two adjacent output terminals of said plurality of output terminals are always output from two adjacent buffer amplifiers of said plurality of buffer amplifiers, further wherein each pair of adjacent output terminals of said output terminals are configured to be supplied selectively by three of said buffer amplifiers with said tone voltages so that a first two of said three of said buffer amplifiers supply said tone voltages during a first time period and a second two of said three of said buffer amplifiers supply said tone voltages during a second time period subsequent to said first time period.

2. The LCD panel driving circuit according to claim 1; wherein said three buffer amplifiers associated with each pair of output terminals are adjacent to each other.

3. An LCD panel driving circuit for feeding output from 2$j$ units of selectors, wherein j is a natural number, to 2$j$ data lines; said circuit comprising:

j units of first-polarity selectors which select a tone voltage based on a data for first-polarity output;

j units of second-polarity selectors which select a tone voltage based on a data for second-polarity output;

j units of first-polarity buffer amplifiers each one of which is connected to each one said first-polarity selectors;

a second-polarity buffer amplifier connectable to one particular unit of said second-polarity selector;

j units of second-polarity buffer amplifiers each one of which is correlated to two units of said second-polarity selectors and are shared by said two units of second-polarity selector;

j units of data-line selection switches each one of which switches a target for connection of said second-polarity selection between the correlated pair of said second-polarity buffer amplifiers at the same time; and 2$j$ units of output-polarity selection switches each one of which switches a target for output of said first-polarity buffer amplifier between a pair of adjacent data lines at the same timing as that of said data-line selection switches, switches a target for output of one second-polarity buffer amplifier of said pair of second-polarity buffer amplifiers between one of said pair of data lines and the data line further adjacent thereto, and also switches a target for output of the other second-polarity buffer amplifier between the other one of said pair of data lines and the data line further adjacent thereto.

4. The LCD panel driving circuit according to claim 3; wherein said first-polarity buffer amplifiers and said second-polarity buffer amplifiers are alternatively arranged with each other.

5. The LCD panel driving circuit according to claim 3; wherein said data-line selection switches and said output-polarity selection switches are controlled to switch according to the same control signal.

6. The LCD panel driving circuit according to claim 3; wherein said buffer amplifiers are formed using operational amplifiers.

7. An LCD panel driving circuit for feeding output from 2*j* units of selectors, wherein j is a natural number, to 2*j* data lines; said circuit comprising:

an LCD panel which can display colors using pixels; and each data line block corresponding to the pixels of said LCD panel displaying the same color has j units of first polarity selectors which select a tone voltage based on a data for first-polarity output;

j units of second-polarity selectors which select a tone voltage based on a data for second-polarity output;

j units of first-polarity buffer amplifiers each one of which is connected to each one of said first-polarity selectors;

a second-polarity buffer amplifier connectable to one particular unit of said second-polarity selector;

j units of second-polarity buffer amplifiers each one of which is correlated to two units of said second-polarity selectors and are shared by said two units of a second-polarity selector;

j units of data-line selection switches each one of which switches a target for connection of said second-polarity selector between the correlated pair of said second-polarity buffer amplifiers at the same timing; and

2*j* units of output-polarity selection switches each one of which switches a target for output of said first-polarity buffer amplifier between a pair of adjacent data lines at the same timing as that of said data-line selection switches, switches a target for output of one second-polarity buffer amplifier of said pair of second-polarity buffer amplifiers between one of said pair of data lines and the data line further adjacent thereto, and also switches a target for output of the other second-polarity buffer amplifier between the other one of said pair of data lines and the data line further adjacent thereto.

* * * * *